United States Patent [19]

Frisbee

[11] 4,237,986

[45] Dec. 9, 1980

[54] FLEXIBLE ROCK GUARD FOR BULLDOZER

[75] Inventor: Claude M. Frisbee, Bettendorf, Iowa

[73] Assignee: J. I. Case Company, Racine, Wis.

[21] Appl. No.: 952,768

[22] Filed: Oct. 19, 1978

[51] Int. Cl.[3] ..... E02F 3/76

[52] U.S. Cl. ..... 172/805; 403/23; 172/809

[58] Field of Search ..... 172/801–809; 277/11; 403/23, 24

[56] References Cited

U.S. PATENT DOCUMENTS

| | | | |
|---|---|---|---|
| 3,083,480 | 4/1963 | Kirchler | 172/803 |
| 3,674,096 | 7/1972 | Berg | 172/805 |
| 3,777,824 | 12/1973 | Anderson | 172/801 |
| 4,074,770 | 2/1978 | Frisbee | 172/804 |

*Primary Examiner*—Richard J. Johnson

*Attorney, Agent, or Firm*—Cullen, Sloman, Cantor, Grauer, Scott & Rutherford

[57] ABSTRACT

A flexible guard for preventing rocks and other debris from becoming trapped in the hollow area between the lift cylinder mounting lugs and then being crushed by one of the angle cylinders when the bulldozer blade is angled. In a first embodiment, the flexible rock and debris guard is fitted around the forward end of the lift cylinder mounting lugs on the bulldozer C-frame. It deflects away from the lift cylinder lugs the debris pushed against it by the retracting angle cylinder when the blade is angled. The rock guard has the additional advantage that the normal lubrication of the lift cylinder rod eye can be accomplished without its removal. A second embodiment of the rock guard includes a solid block of rubber or plastic that fits in the hollow space between the upstanding lift cylinder mounting lugs, and it has deflecting surfaces and flexible end portions permitting lubrication of the lift cylinder rod eye thereby providing the same general features as the first embodiment.

1 Claim, 6 Drawing Figures

FIG. 2
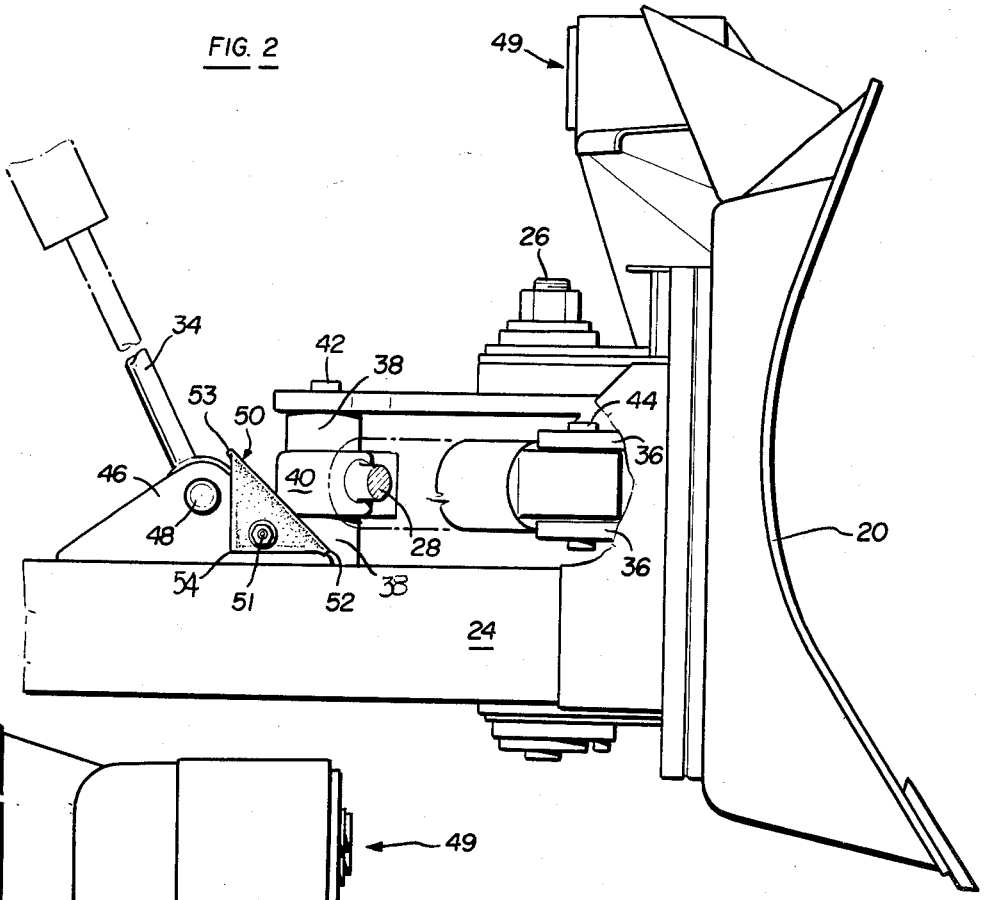
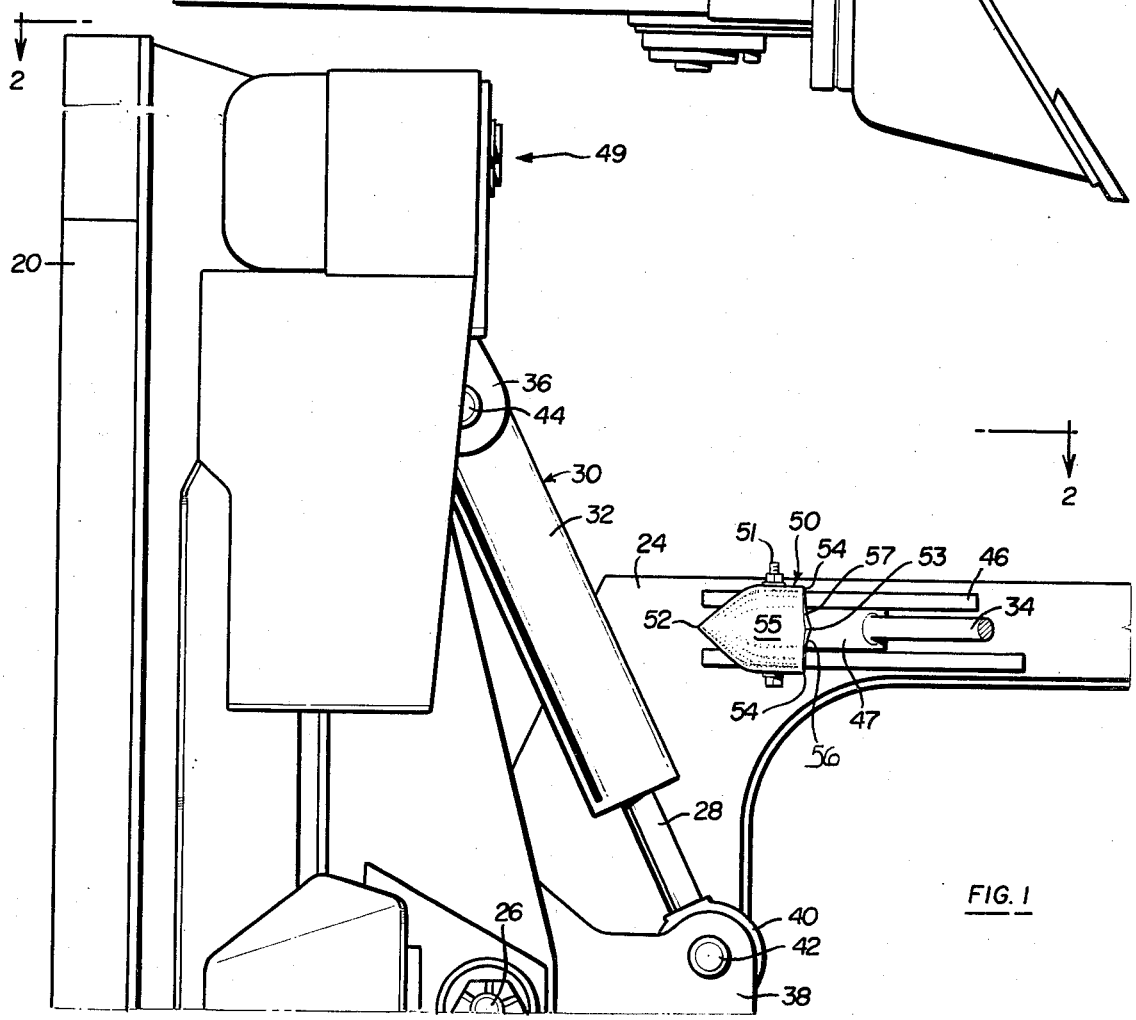
FIG. 1

FLEXIBLE ROCK GUARD FOR BULLDOZER

BACKGROUND OF THE INVENTION

The present invention relates to bulldozers or the like having transversely extending blades, and more particularly to a flexible rock guard that prevents rocks and other debris from damaging the angle cylinder tube wall, the lift cylinder piston rod eye, or the lift cylinder mounting lugs when the dozer blade is angled.

The blade of an angling bulldozer is generally supported on a C-shaped frame which is pivotally connected adjacent its ends to the sides of the bulldozer as shown in U.S. Pat. No. 4,074,770 which is assigned to the assignee of the instant application. The blade is supported adjacent its mid portion to the center of the frame, and the opposed sides are connected to hydraulic cylinders for angling the blade. One angle cylinder is extended while the opposed cylinder is retracted to adjust the blade about a vertical axis.

At present, rocks and other debris fall over the top of the blade during operation of the bulldozer and lie on the top of the C-frame in front of the lift cylinder mounting lugs. When the blade is angled, one of the angle cylinders retracts and swings about a vertical pivot such that its cylindrical tube wall nearly abuts the lift cylinder lugs upstanding on the C-frame. The retracting angle cylinder pushes any rocks or debris lying on the top of the C-frame toward the lift cylinder lugs. Rocks and debris are sometimes trapped in the hollow space between the upstanding lift cylinder lugs and then crushed between the angle cylinder tube wall and the lift cylinder lugs during blade angling. The result is damage to the angle cylinder tube wall, the lift cylinder piston rod eye, or the lift cylinder mounting lugs which may necessitate repairs before continued operation of the machine.

These disadvantages of the present bulldozer construction have resulted in the flexible rock guard of the present invention. The rock guard is installed on the forward end of the lift cylinder mounting lugs and prevents rocks and other debris from being trapped between the lift cylinder lugs and the angle cylinder tube wall.

SUMMARY OF THE INVENTION

The flexible rock and debris guard of the present invention may be utilized in a conventional bulldozer having a C-shaped frame such as that disclosed in U.S. Pat. No. 4,074,770 wherein the blade is mounted on the frame for angling movement about a vertical axis. The angling control includes a pair of piston-cylinders with piston rods connected to the C-shaped frame and their opposed ends operably connected to the respective sides of the bulldozer blade. The hydraulic control for the angle cylinders simultaneously extends the piston rod of one cylinder while retracting the piston rod of the opposed cylinder to angle the bulldozer blade about a vertical axis.

In the preferred embodiment of the invention, a flexible rock and debis guard is fitted around the forward end of the lift cylinder mounting lugs on the bulldozer C-frame. The rock guard prevents rocks and other debris from being trapped in the hollow area between the mounting lugs and then being crushed by one of the angle cylinders when the bulldozer blade is angled and in particular to its maximum position.

The flexible rock guard of the present invention has several unexpected advantages. It deflects the rocks and debris away from the lift cylinder lugs on the C-frame when the angle cylinder being retracted during angling pushes rocks or debris against it. This provides the advantage that the rocks are prevented from being trapped between the mounting lugs and damaging the angling cylinders or the lift cylinders. The rock guard has the additional advantage that it does not obstruct the normal lubrication of the lift cylinder rod eye. During lubrication of the rod eye, the top corner of the flexible rock guard is pulled fowardly and pushed downwardly to provide access to the lubrication fitting.

The first embodiment of the rock and debris guard includes an upwardly pointing triangularly shaped flap, a downwardly pointing triangularly shaped flap, and two laterally spaced corners wherein the guard is held to the upstanding lift cylinder mounting lugs by a horizontal bolt passing through holes in the laterally spaced corners. The surface of the guard connecting and spanning the laterally spaced corners is generally arcuate, and it deflects away from the mounting lugs any debris pushed against it. The upwardly pointing triangular flap is pulled outwardly and pushed downwardly during lubrication of the lift cylinder piston rod eye mounted between the lift lugs. The triangular flap portions provide relief to the arcuate surface of the guard spanning the hollow opening between the upstanding mounting lugs so that the rock guard is adjustable to accommodate various spacings between the lugs while still retaining its arcuate shape.

In a second embodiment, the rock and debris guard is a solid block of rubber or plastic having in one instance a solid core portion which fits between the lift cylinder mounting lugs and which is secured thereto by a bolt passing through the lugs and the core. Alternatively, the solid block rock guard has laterally spaced depending legs which are secured between the lift cylinder mounting lugs. A deflecting portion of the solid block rock guard, which is rectangular or triangularly shaped in cross-section, covers the hollow space between the upstanding mounting lugs and deflects away debris pushed against it by the retracting angle cylinder. A flexible flap portion on the rock guard provides access to the lift cylinder piston rod eye for lubrication as in the first embodiment.

In both embodiments, the flap portion of the rock guard normally covers and protects the lubrication fitting on the lift cylinder piston rod eye which is angularly spaced from the longitudinal axis of the piston rod. The flexible flap is bent away from the lubrication fitting when lubrication becomes necessary, but the flap returns to its cover position once the bending force is removed.

Other advantages and meritorious features of the flexible rock and debris guard of the present invention will be more fully understood from the following description of the preferred embodiments, the appended claims and the drawings. A brief description of which follows.

BRIEF DESCRIPTION OF THE DRAWINGS

FIG. 1 is a partial top elevation of the left side of a conventional bulldozer illustrating a bulldozer blade pivotally mounted on a C-frame, the left side angling cylinder and having mounted around the lift cylinder mounting lugs the flexible rock and debris guard of the present invention;

FIG. 2 is a partial side elevation of the bulldozer blade assembly shown in FIG. 1 having a portion of one angling cylinder cut away for easier viewing;

DESCRIPTION OF THE PREFERRED EMBODIMENTS

Figure 3:
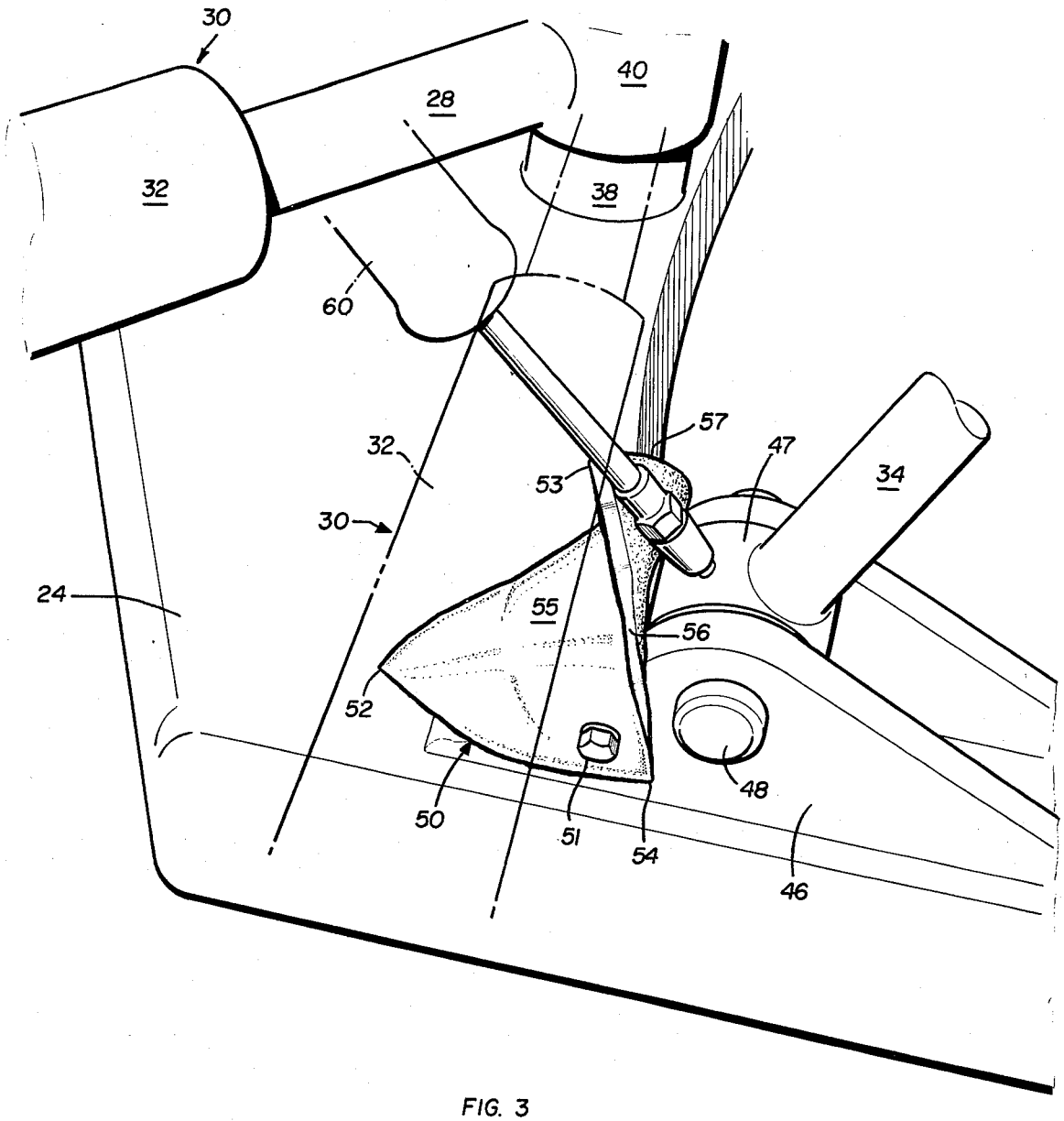
FIG. 3 is a perspective detail showing the right angling cylinder and the operation and advantages provided by the flexible rock and debris guard of the present invention.

A bulldozer blade having one embodiment of the flexible rock guard of the present invention is shown in FIGS. 1–3. It will be understood that the flexible rock guard may be utilized in other implements having the prior art problems described hereinabove. For example, the flexible rock guard may be utilized in a wheeled vehicle or tractor. The following description will be limited to a bulldozer of the type shown for simplicity of illustration.

The bulldozer includes a conventional transverse scrapper blade 20 which is supported on a C-shaped frame assembly 24. The mid portion of the blade is supported on the C-frame for pivoting about a vertical center pivot 26.

In the embodiment of the bulldozer shown in FIGS. 1–3, the blade 20 may be angled about the vertical center pivot 26 by simultaneously extending one of the piston rods 28 of the angling cylinders 30 shown in FIGS. 1 and 3 and retracting the other to angle the blade about the vertical axis 26. The blade is raised and lowered by lift cylinders (not shown) wherein their piston rods 34 are retracted to lift or raise the C-shaped frame and pivotally attached blade assembly, and the rods 34 are extended to lower the assembly.

The embodiment of the angle control shown in FIGS. 1–3 includes one piston-cylinder 30 shown on the left hand side of the bulldozer blade, (FIG. 1) and a second cylinder identical in construction, mounting and operation to the first, is mounted on the right hand side of the blade as shown in FIG. 3. The cylinders are connected between mounting lugs 36 welded on the back side of the blade and mounting lugs 38 on the C-shaped frame. The piston rod eye 40 of each angle cylinder is pivotally connected by a vertical pin 42 to the mounting lugs 38 on the C-shaped frame, and the opposite end of each angle cylinder is mounted to lugs 36 on the back of blade 20 by vertical pin 44.

The upstanding lift cylinder mounting lugs 46 are welded or otherwise secured to the C-shaped frame 24. The piston rod eye 47, mounted on the end of lift cylinder piston rod 34, is mounted between the lugs 46 by horizontal pivot pin 48. The horizontal portion of the C-shaped frame 24 in front of the lift lugs (illustrated in FIGS. 1 and 3) accumulates rocks or debris that fall over the top of the blade during operation. The shielding surfaces on the top of the blade, generally shown by 49, do not deflect all the debris away from the C-shaped frame and consequently rocks fall over the top of the blade and lie on the top of the C-shaped frame in front of the lift cylinder mounting lugs 46.

The flexible rock and debris guard 50 of the present invention prevents rocks and other debris from becoming trapped in the hollow space between the lugs 46. The rock guard illustrated in FIGS. 1–3 is made of a flexible material such as two-ply polyester belting, however other materials are within the scope of the invention. The rock guard illustrated in FIGS. 1–3 includes a square piece of polyester belting, having holes in two diagonally spaced apart corners 54, which is folded over the outside front end of the lugs 46 thereby covering the open space between the lugs. The guard is mounted to the lugs by passing a bolt 51 through its opposed corner holes. The mounted rock guard forms an arcuate cover 55 over the hollow space between the lugs precluding the entry of debris. A feature of the present invention is that it is not necessary to remove the rock guard to lubricate the piston rod eye 47 of the lift cylinder. As illustrated in FIG. 3, the piston rod eye can be lubricated by pulling the top corner 53 of the rock guard forwardly and pushing downwardly until a lubrication gun 60 can be placed on the lubrication fitting of the piston eye 47.

The installed rock and debris guard 50 includes a downwardly pointing corner 52, an upwardly pointing corner 53, and two laterally spaced corners 54 wherein the corners 54 are held to the sides of upstanding lugs 46 by a horizontal bolt 51 passing through holes in the corners. The surface 55 of the guard is generally arcuate between the corners 54, and it deflects any rocks or debris pushed against it away from the upstanding lift cylinder mounting lugs 46 and the C-shaped frame 24. While the guard illustrated in FIGS. 1–3 is made of polyester belting bent around the front end of mounting lugs 46 to form an arcuate deflecting surface 55, it is within the scope of the present invention to provide a flexible guard that is pre-formed into the configuration illustrated.

The upwardly pointing corner 53 has spaced apart lateral edges 56 and 57 that are inclined upwardly and inwardly to form an essentially triangular shaped flap. This triangular shape permits the corner to be pulled outwardly and pushed downwardly for lubrication of the piston rod eye 47 without removal of the rock guard. The downwardly pointing corner 52 is also triangularly shaped, and the triangular flap portions 52 and 53 provide relief to the surface 55 spanning the hollow opening between the upstanding lugs 46 so that the rock guard is adjustable to accommodate various spacings between the lugs while still retaining its arcuate deflecting shape.

The operation of the flexible rock guard illustrated in FIGS. 1–3 is as follows. Assuming that it is desired to angle the blade 20 about its vertical pivot 26, the angle cylinder 30 shown in FIG. 1 is extended and simultaneously the angle cylinder 30 illustrated in FIG. 3 is retracted thereby swinging the cylinder's tube wall 32 about vertical pivot 42 to the phantom line position shown in FIG. 3. The swinging movement of the angling cylinder 30 to the phantom line position pushes any rocks or other debris that were lying on the horizontal portion of the C-shaped frame in front of the upstanding lugs 46 against rock guard 50. The rocks or debris are deflected away from the hollow space between the lugs 46 by the arcuate deflecting surface 55 of the rock guard thereby preventing rocks from becoming lodged between the lugs and the hollow cylinder tube wall 32. This precludes damage to the cylinder tube wall 32, the piston rod eye 47, or the mounting lugs 46 that has heretofore occurred when rocks are crushed between the angling cylinder and the mounting lugs.

Figure 4:
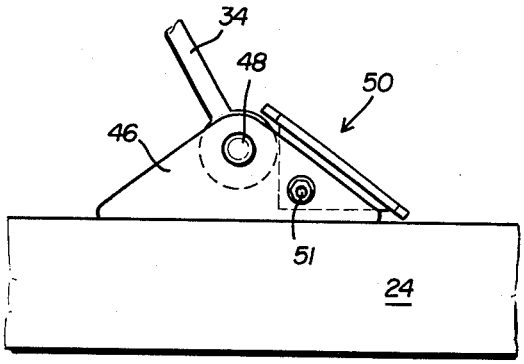
FIG. 4 is a detail showing an alternate embodiment of the rock guard mounted between the lift cylinder mounting lugs.
Figure 5A:
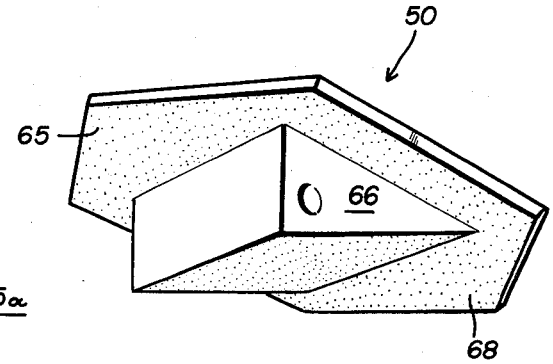
FIG. 5*a* is a perspective detail of the alternative rock guard embodiment illustrated in FIG. 4.
Figure 5B:
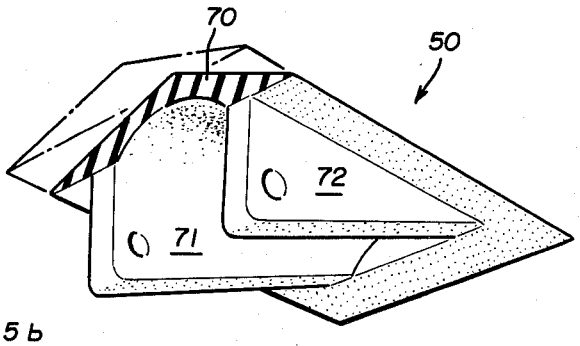
FIG. 5*b* is a perspective detail of the alternative rock guard embodiment with laterally spaced depending legs instead of a solid core base.

A second embodiment of the flexible rock guard 50 is illustrated in FIGS. 4, 5*a*, and 5*b*. As shown, the rock guard comprises a solid block of rubber or plastic having either a solid core portion 66 (FIG. 5*a*) or laterally spaced depending legs 71, 72 (FIG. 5*b*) suitable for mounting between the upstanding lift cylinder mounting lugs 46, and it is secured thereto by bolt 51 which passes through the core 66 or through legs 71, 72. The deflecting portion 70 of the solid block rock guard is either triangular in cross-section (FIG. 5*b*) or rectangular (FIG. 5*a*) and covers the hollow space between the lugs 46 to deflect debris pushed against it by the retracting angle cylinder. Flexible flap portions 65 and 68 yield outwardly under pressure for lubrication of the piston rod eye 47 without removal of the rock guard.

The flap portion of the rock guard 50 normally covers and protects the lubrication fitting on piston rod eye 47 as illustrated in FIG. 3. The fitting is angularly spaced from the longitudinal axis of the piston rod 34, and when lubrication of the rod eye 47 becomes necessary, the flexible flap is bent outwardly away from the fitting. The flap returns to its cover position once the bending force is removed.

It would be apparent to those skilled in the art that the foregoing disclosure is exemplary in nature rather than limiting, the invention be limited only by the appended claims.

I claim:

1. In a vehicle having a C-shaped frame surrounding the forward end of said vehicle and a transverse scraper blade pivotally mounted on a vertical axis adjacent its midportion to the forward end of said frame, each side of said blade operably connected to said frame by angling means permitting angling movement of said blade about said vertical axis, at least one upstanding and spaced apart lug means mounted on said C-shaped frame, at least one piston-cylinder for lifting and lowering the C-shaped frame and blade, one end of said piston-cylinder mounted between said upstanding lug means and the other end mounted to said vehicle, the improvement comprising:

a flexible rock and debris guard mounted to the forward end of said upstanding lug means and covering the hollow area between said lug means to prevent rocks and other debris from becoming trapped between said upstanding and spaced apart lug means, said guard having an arcuate shaped body portion for deflecting said debris, said body portion including upper and lower triangularly shaped flap portions that are yieldable and laterally opposed corner portions which are secured to the sides of said upstanding lug means whereby during angling movement one of said angling means swinging about a vertical pivot on said frame and pushing debris against said guard, said guard deflecting away from said lug means the debris pushed against it by said angling means, said one end of said piston-cylinder including a piston rod eye having a lubrication fitting, said piston rod eye mounted to a piston rod and said lubrication fitting being angularly spaced from the longitudinal axis of said piston rod on said piston rod eye whereby said upper triangularly shaped flap portion normally covers and protects said lubrication fitting, said upper flap portion being pulled forwardly away from said lug means and pushed downwardly to permit lubrication of said piston rod eye without removing said rock guard.

* * * * *